United States Patent [19]

Lüthi

[11] 4,198,835

[45] Apr. 22, 1980

[54] DEVICE RELATING TO HEATER UNITS FOR THE HEAT-TREATMENT OF TEXTILE YARNS

[75] Inventor: Walter Lüthi, Ebnat-Kappel, Switzerland

[73] Assignee: Heberlein Maschinenfabrik AG, Wattwil, Switzerland

[21] Appl. No.: 5,852

[22] Filed: Jan. 23, 1979

[30] Foreign Application Priority Data

Jan. 26, 1978 [CH] Switzerland ..... 844781/78

[51] Int. Cl.[2] ..... D06B 23/18

[52] U.S. Cl. ..... 68/5 E; 328/281; 34/242; 68/18 F

[58] Field of Search ..... 68/5 D, 5 E, 6, 18 F, 68/DIG. 1; 34/242; 28/255, 281; 188/50, 405

[56] References Cited

U.S. PATENT DOCUMENTS

| | | | |
|---|---|---|---|
| 2,398,856 | 4/1946 | Reel | 68/6 |
| 2,920,346 | 1/1960 | Jori | 68/5 D X |
| 3,555,639 | 1/1971 | Van Doornewaard | 28/281 X |
| 4,100,660 | 7/1978 | Nemecek et al. | 68/5 E X |

*Primary Examiner*—Philip R. Coe

*Attorney, Agent, or Firm*—Young & Thompson

[57] ABSTRACT

Apparatus for heat-treating textile yarn includes a heater tube (3) through which the yarn is passed, the tube (3) having a holder (2) at each end and a seal in the form of a stopper (5) fitted into a neck (4). The stopper (5) has a groove (10) on its outer surface for guiding the yarn through the heater tube (3). Steam is introduced at the yarn entry end of the heater tube (3), passes over the groove (10) and is removed via passages (11) in the stopper and a suction pipe (7) connected to the passages. The heater tube (3), suction tube (7) and steam supply tube (8) are surrounded by an insulating housing (1) to minimize heat losses.

5 Claims, 5 Drawing Figures

DEVICE RELATING TO HEATER UNITS FOR THE HEAT-TREATMENT OF TEXTILE YARNS

This invention relates to a heater unit for the heat-treatment of textile yarns, especially but not exclusively, those made from fully synthetic thermoplastic material, such as polyamides and polyesters.

A known heater unit for this purpose comprises a cylindrical receptacle containing a heating medium, such as saturated steam at pressures exceeding atmospheric pressure, the yarn being passed through it along its axis. The receptacle is sealed at both ends by stoppers comprising either a capillary tube or metal cylinders having capillary boreholes.

Our Swiss Pat. No. 594 761 describes a heater unit of this type comprising a neck having a plunger-like stopper, its surface being provided with a U-shaped groove. The depth and width of the U-shaped groove are approximately identical, preferably ranging from 0.1 to 0.5 mm. This seal facilitates the rapid threading-up of the heater unit, the heating-medium losses being maintained at relatively low levels, even though the heating-medium pressures are applied at relatively high levels, covering a 25 atmospheres-and-over range.

Even with this type of seal, however, heating-medium and water losses occur under specific operating conditions, for instance, in the case of yarn breaks, the disadvantage being that the escaping heating medium, e.g. steam, takes with it the spin-finish emanating from the yarns passing through the heater unit, penetrating the surrounding air and polluting it. Furthermore, the steam forming condensation or the water escaping from the heater unit may lead to serious contamination of the machine. The object of the invention is to attempt to remove this shortcoming and to produce a heater unit having maximum water-tightness under all operating conditions so as to eliminate the pollution of the surrounding air and the contamination of the unit.

Broadly stated, the invention consists in apparatus for heat-treating textile yarn, comprising a heater tube through which the yarn can be passed lengthwise with a fluid heating medium, the heater tube having a seal at each end, each seal including a removable sealing member having a groove on its outer surface for guiding the yarn, a suction outlet connected to the groove in each sealing member, and heating medium supply means for supplying heating medium to the heater tube via a filter located at the yarn entry end of the heater tube.

Preferably two passages are provided in each groove for connecting the grooves to the suction outlet.

The filter may be tubular in shape, the surface of the filter having a plurality of apertures.

The advantage of the apparatus of the invention is that, with the suction outlet connected to the sealing members in the heater tube, the escape of steam or water is not only eliminated under all operating conditions, but a minimum steam consumption is also achieved, thereby dispensing with a separate fume removal.

The invention may be performed in various ways and a specific embodiment will now be described by way of example with reference to the accompanying drawings, in which.

Figure 1:
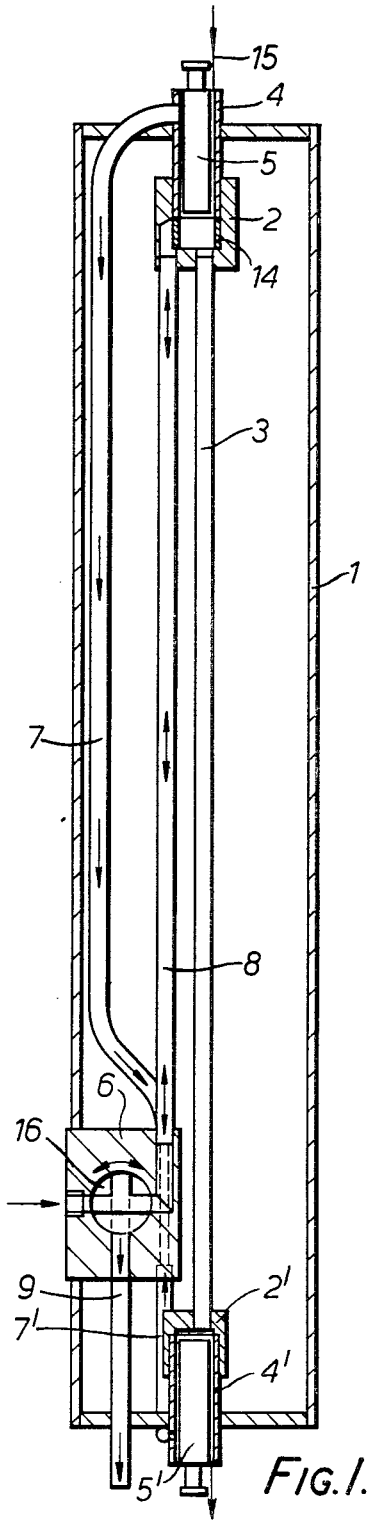
FIG. 1 shows a first longitudinal section through a heater unit.
Figure 2:
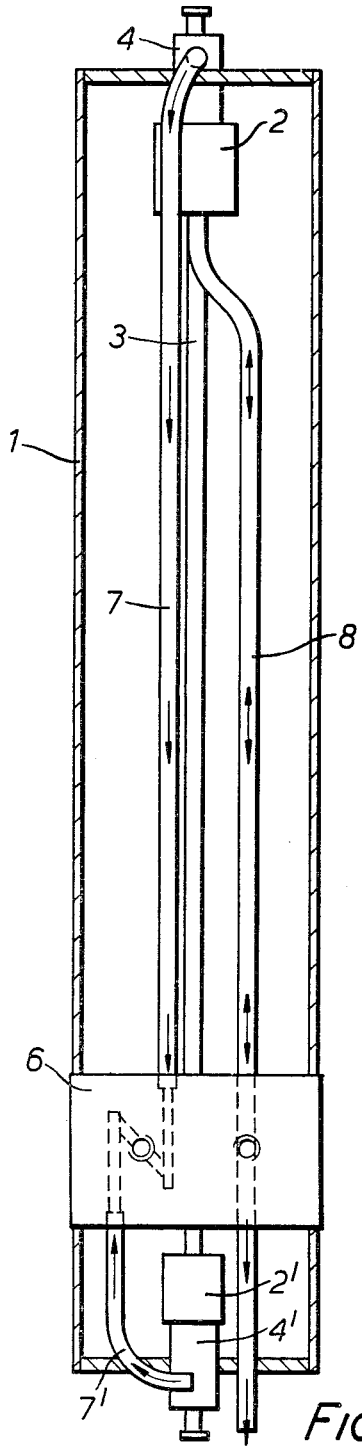
FIG. 2 shows a second longitudinal section through the unit of FIG. 1, its sectional plane being at right angles to the sectional plane of the first longitudinal section.
Figure 3:
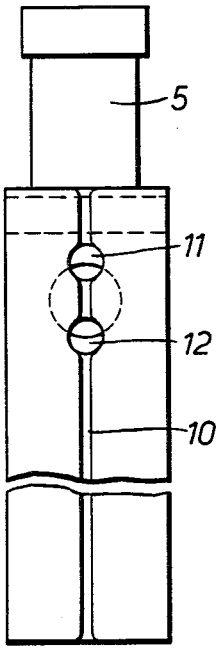
FIG. 3 shows an enlarged detail of FIG. 1.
Figure 4:
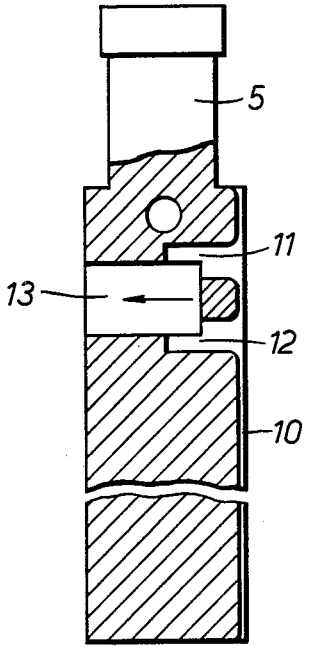
FIG. 4 shows an enlarged detail of FIG. 2.
Figure 5:
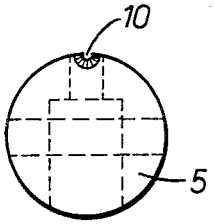
FIG. 5 shows a view of the detail in accordance with FIGS. 3 and 4 from below.

FIGS. 1 and 2 show a heater tube 3 which uses steam as a heating medium and has two seals comprising necks 4, 4' and stoppers 5, 5'. The tube 3 is secured in holders 2, 2' within an aluminium cylinder 1 serving as a housing. A steam-supply tube 8 connected to a three-way valve 16 and a suction tube 7 connected to a valve (not shown) are located on a support 6 within the housing 1. The steam-supply tube 8 is in turn connected to a tube 9 for draining steam and condensate through the three-way valve 16. The steam-supply tube 8 is linked to the yarn-entry end of the heater tube 3, the yarn entry end having an internal diameter of about 4 mm. In addition, the housing 1 is packed with insulating material (not shown).

Each stopper 5 or 5' is provided with a U-shaped groove 10 along its outer surface, the width and depth of the groove each being approximately from 0.1 to 0.5 mm. Leading from the groove 10, there are two endwise, evenly spaced boreholes 11 and 12 which are connected to the suction tube 7, 7' through a borehole 13. Located in the holder 2 between the top end of the heater tube 3 and the seal 4, 5 is a filter 14 comprising a tubular portion, its surface being perforated with a large number of holes each being 1 mm in diameter.

Before threading-up the heater unit, the stoppers 5, 5' are removed and yarn 15, to which a weight (not represented) is attached, is introduced into the heater tube 3, falling to the bottom end of the tube by gravity, where it is caught and drawn into further sections of the machine (not shown). Following this, the yarn 15 is laid into the grooves 10 of the stoppers 5, 5', the latter being replaced in the necks 4, 4'.

The machine is then started, the three-way valve 16 being opened upon reaching the maximum operating speed so that saturated steam from a steam source (not shown) enters the heater tube 3, passing through the steam-supply tube and the filter 14 on the way. At the same time the suction tube 7, 7' is connected to the boreholes 11, 12, 13 by opening the valve connected to the tube 7, 7'. The yarn 15 passing through the heater unit conveys the condensed steam to the bottom end of the heater tube 3, the condensed steam being removed from the seal 4', 5' through the suction tube 7.

Should a yarn break occur, or the feeder package be completely unwound, steam, condensed steam in the form of water and spin-finish contained in both these media are prevented from escaping into the surrounding air by the boreholes 11, 12 connecting the grooves 10 to the suction tube 7, 7'. Furthermore, the filter 14 eliminates broken pieces of yarn that would otherwise leave the heater tube 3 and enter the steam-supply tube 8, becoming lodged in the valve and hence possibly damaging it. When the machine is stopped, the steam-supply tube 8 is connected to the tube 9 through the three-way valve 16 to allow the steam or condensed steam still present in the heater unit to escape. The valve in the suction tube 7, 7' can then be closed and the stoppers 5, 5' removed from the necks 4, 4'.

We claim:

1. Apparatus for heat-treating textile yarn, comprising a heater tube through which the yarn can be passed lengthwise with a fluid heating medium, a seal at each end of the heater tube including a removable sealing member having a groove on its outer surface for guiding the yarn, a suction outlet connected to the groove in each sealing member, a filter located at the yarn entry end of the heater tube, and heating medium supply means for supplying the fluid heating medium to the heater tube via the filter.

2. Apparatus according to claim 1, in which two passages are provided in each groove for connecting the grooves to the suction outlet.

3. Apparatus according to claim 1, in which the filter is tubular in shape, the surface of the filter being perforated to define a plurality of apertures.

4. Apparatus according to claim 1, in which a passage is included in each seal, the removable sealing member being fitted into said passage.

5. Apparatus according to claim 1, in which an insulating jacket surrounds said heater tube and both the suction outlet and the heating medium supply means include tubular passages through the jacket.

* * * * *